US005105221A

United States Patent [19]

Takahashi et al.

[11] Patent Number: 5,105,221

[45] Date of Patent: Apr. 14, 1992

[54] IMAGE FORMING APPARATUS HAVING DETACHABLE OPTICAL AND PROCESSING UNITS

[75] Inventors: Tomohiko Takahashi; Hidetoshi Aoki, both of Yokohama, Japan

[73] Assignee: Kabushiki Kaisha Toshiba, Kawasaki, Japan

[21] Appl. No.: 620,632

[22] Filed: Dec. 3, 1990

[30] Foreign Application Priority Data

Dec. 4, 1989 [JP] Japan ..... 1-315102

[51] Int. Cl.[5] ..... G03G 15/00

[52] U.S. Cl. ..... 355/210; 355/200

[58] Field of Search ..... 355/200, 210, 211, 232, 355/235, 245, 260; 222/DIG. 1; 358/300, 401; 346/153.1, 157, 160, 160.1, 145; 361/331, 392

[56] References Cited

U.S. PATENT DOCUMENTS

| | | | |
|---|---|---|---|
| 4,642,661 | 2/1987 | Dean, II | 346/153.1 |
| 4,668,072 | 5/1987 | Yasuda | 355/211 |
| 4,708,455 | 11/1987 | Kubota et al. | 355/211 |
| 4,876,572 | 10/1989 | Nagatsuna | 355/210 |
| 4,912,563 | 3/1990 | Narita | 355/200 X |
| 4,965,640 | 10/1990 | Watarai et al. | 355/283 |

*Primary Examiner*—A. T. Grimley
*Assistant Examiner*—Christopher Horgan
*Attorney, Agent, or Firm*—Foley & Lardner

[57] ABSTRACT

An image forming apparatus comprises a support frame arranged in a main body. The support frame is integrally provided with at least first to third support portions. An image forming process cartridge is supported and positioned by the first support portion. An optical unit is supported and positioned by the second support portion with respect to the cartridge. A transfer charger is supported and portioned by the third support portion with respect to the cartridge.

13 Claims, 6 Drawing Sheets

FIG.

IMAGE FORMING APPARATUS HAVING DETACHABLE OPTICAL AND PROCESSING UNITS

BACKGROUND OF THE INVENTION

1. Field of the Invention

The present invention relates to an image forming apparatus, such as an electrophotographic copying machine, a laser printer, or the like, for forming an image by an electrophotographic process.

2. Description of the Related Art

In recent years, image forming apparatuses of this type has been reduced in size. With this reduction in size, in order to improve the assembly and maintenance performance, constituent parts housed in the apparatus main body are often formed into a unit.

For example, an image carrier, a charger, a developing device, and a cleaning device are formed as an image forming process cartridge. In addition, exposure/optical systems for exposing the image carrier surface to form an electrostatic latent image on the image carrier prior to a developing operation are formed as an optical unit.

In a conventional apparatus, the image forming process cartridge, the optical unit, a transfer unit for transferring a developing agent image, which is formed on the image carrier, onto a transfer medium, and the like are mounted in the main body while they are positioned at predetermined positions by positioning pins, studs, independent positioning frames, guides, and the like, respectively arranged on the apparatus frame.

If, however, the process cartridge, the optical unit, the transfer unit, and the like are positioned by the positioning pins, the studs, the positioning frames, the guides, or the like, it is difficult to position these members precisely. The relative positions between these members greatly influence image quality. Furthermore, problems are posed in terms of assembly performance and manufacturing cost.

SUMMARY OF THE INVENTION

The present invention has been in consideration of the above situation, and has as its object to provide an image forming apparatus in which the relative positions between at least an image forming process cartridge, an optical unit, and transferring means can be maintained with high precision so as to allow formation of an image having good image quality, while the assembly performance can be improved, and the manufacturing cost can be reduced.

In order to achieve the above object, according to the present invention, there is provided an image forming apparatus comprising: a process unit removably mounted to a body of the apparatus and having an image carrier, and means for forming an image on the image carrier; an optical unit for exposing a light on the image carrier to form a latent image thereon; a transfer unit for transferring the image formed on the image carrier onto a transfer medium; and a support unit provided on the body and having a base member which includes a first support portion for positioning the process unit, a second support portion for positioning the optical unit, and a third support portion for positioning the transfer unit.

According to the image forming apparatus having the above-described arrangement, at least the process unit, the optical unit, and the transfer unit, which tend to influence image quality, are supported and positioned by a common support unit having a plurality of support portions. With this arrangement, a stable positional relationship among the respective components can be realized, to allow formation of an image having excellent image quality in comparison with the conventional apparatus in which positioning of the respective components is performed by positioning, pins, studs, positioning frames, guides, or the like, arranged on the frame of an apparatus main body. In addition, a decrease in the number of components enables improvements in assembly performance and reduction in manufacturing cost.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 4 show an image forming apparatus according to an embodiment of the present invention, in which:

FIG. 1 is a sectional view showing the overall apparatus,

FIG. 2 is an enlarged sectional view of an image forming process cartridge,

FIG. 3 is a schematic sectional view showing a state wherein the constituent members are supported on a support frame, and FIG. 4 is an exploded perspective view showing the support frame and main components supported thereon; and FIGS. 5 to 7 schematically show the second embodiment of the present invention, in which:

FIG. 5 is a perspective view showing a support frame and main components supported thereon, FIG. 6 is a side view showing one of side plates of the support frame, and FIG. 7 is a schematic front view showing a state wherein guide rails and a process unit are engaged with each other.

DETAILED DESCRIPTION OF THE PREFERRED EMBODIMENTS

Embodiments of the present invention will be described with reference to the accompanying drawings.

Figure 1:
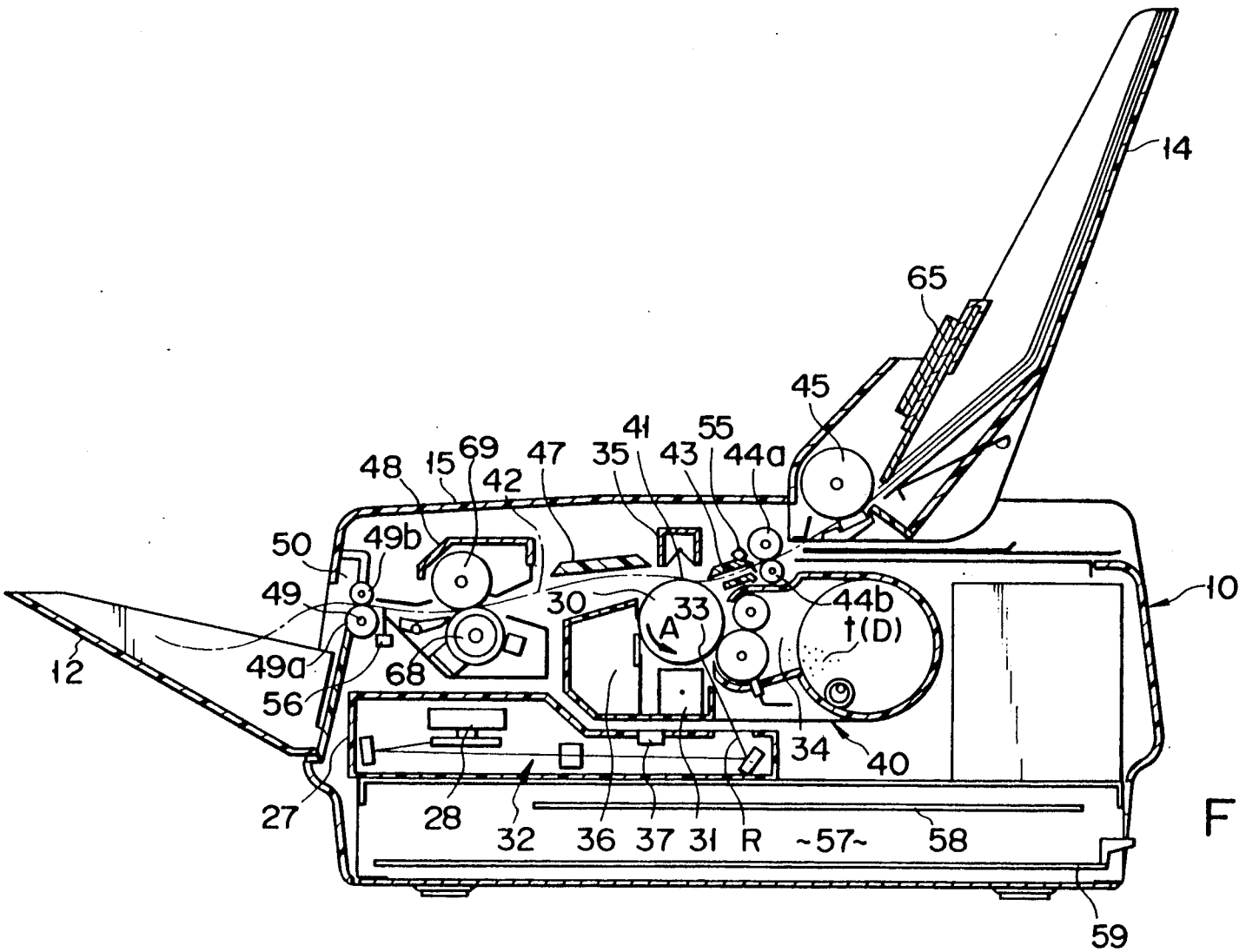

As shown in FIG. 1, a laser printer as an image forming apparatus according to an embodiment includes an apparatus main body 10. A detachable paper discharge tray 12 is arranged on the front portion of the main body 10. A paper cassette 14 for storing sheets of paper P as a transfer medium is mounted on the upper portion of the main body 10.

A photoconductive drum 30 as an image carrier is rotatably arranged in the main body 10. The following components are sequentially arranged around the drum 30 in a rotating direction of the drum indicated by an arrow A: a charger 31 constituted by a Scorotron; an exposure portion 33 for receiving laser beam R emitted from a laser exposure unit 32 as optical means; a non-magnetic one-component developing unit 34; a transfer charger 35, constituted by a Corotron; a drum cleaner 36; and a pre-exposure unit 37.

Of these components, the photoconductive drum 30, the charger 31, the developing unit 34, and the drum cleaner 36 are formed into a unit to constitute an image forming process cartridge 40 arranged in the apparatus main body 10 to be removable therefrom.

Figure 2:
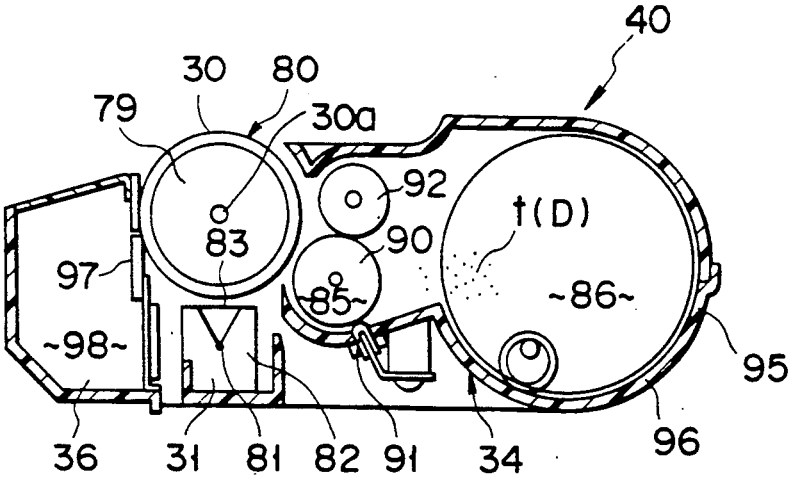

As shown in FIG. 2, the photoconductive drum 30 is designed such that an organic photosensitive file 80 is coated on the outer circumference of an aluminum pipe 79, having a diameter of 30 mm. The charger 31 is arranged to face or oppose the drum 30. The charger 31 includes a 60-μm thick charging wire 81 consisting of white tungsten and extending parallel to the drum 30, a shield case 82 enclosing the charge wire 81, and a grid 83 constituted by a 0.2-mm thick stainless steel plate. The drum cleaner 36 includes an elastic blade 97 for scraping residual toner particles from the drum 30, and an accumulating portion 98 for collecting the scraped toner. The developing unit 34 includes a casing 96 constituting a frame 95 of the process cartridge 40. A developing roller 90, a sponge roller 92, toner t, and the like are housed in this casing 96. The photoconductive drum 30, the charger 31, and the cleaner 36 are attached to the frame 95.

This process cartridge 40 is replaced with a new one after it is used for printing of a predetermined number of sheets of paper.

As shown in FIG. 1, in the main body 10 is defined a paper convey path 42 for guiding paper P supplied from the paper cassette 14 to the paper discharge tray 12 through an image transfer portion 41 formed between the photoconductive drum 30 and the transfer charger 35. On the upstream side of the image transfer portion 41 on the convey path 42, upper and lower aligning rollers **44*a* and 44*b* as feeding means, a pickup roller 45 and the paper cassette 14 are arranged in this order. A first paper guide 43 is arranged between the aligning rollers 44*a* and 44*b* and the transfer charger 35 so as to guide the paper P, which is fed by the aligning rollers 44*a* and 44*b*, to the transfer portion 41. On the downstream side of the image transfer portion 41, a heat roller type fixing unit 48 and a paper discharge roller pair 49 are arranged. A second paper guide 47 is arranged between the transfer charger 35 and the fixing unit 48 so as to guide the paper P from the transfer portion 41 to the fixing unit 48**.

The fixing unit 48 comprises a heat roller 68 incorporating a heater lamp, and a press roller 69 urged against the roller 68. When the paper P, having a toner image formed thereon, passes between these rollers 68 and 69, the toner image is melted/fixed on the paper P. The rollers are enclosed within a substantially rectangular casing to ensure an excellent temperature atmosphere required for a fixing operation.

The paper discharge roller pair 49 is constituted by lower and upper rollers **49*a* and 49*b*. In addition, a discharge brush 50 which is brought into contact with a non-image formation surface side of the paper P is arranged near the discharge roller pair 49**.

The laser exposure unit 32 comprises a laser diode (not shown), a polygon mirror 28, a reflecting mirror, an fθ lens, and the like, which are housed in a casing 27 having a substantially rectangular, box-like shape.

The printer includes a support frame 100 as a support member arranged in the main body 10. The following components are supported and positioned by the support frame 100: the process cartridge 40; the exposure unit 32, the fixing unit 48; the transfer charger 35; the first and second paper guides 43 and 47; and the aligning roller **44*b***.

Figure 3:
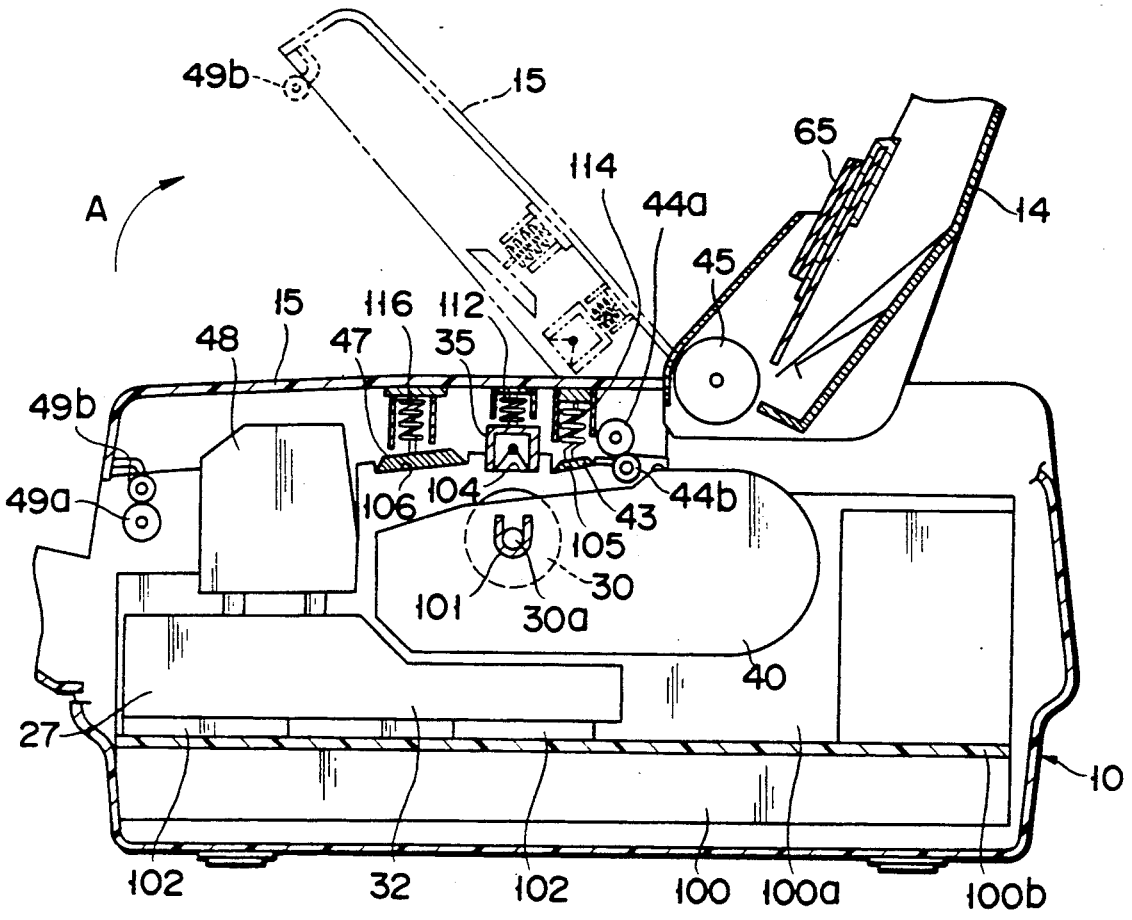
Figure 4:
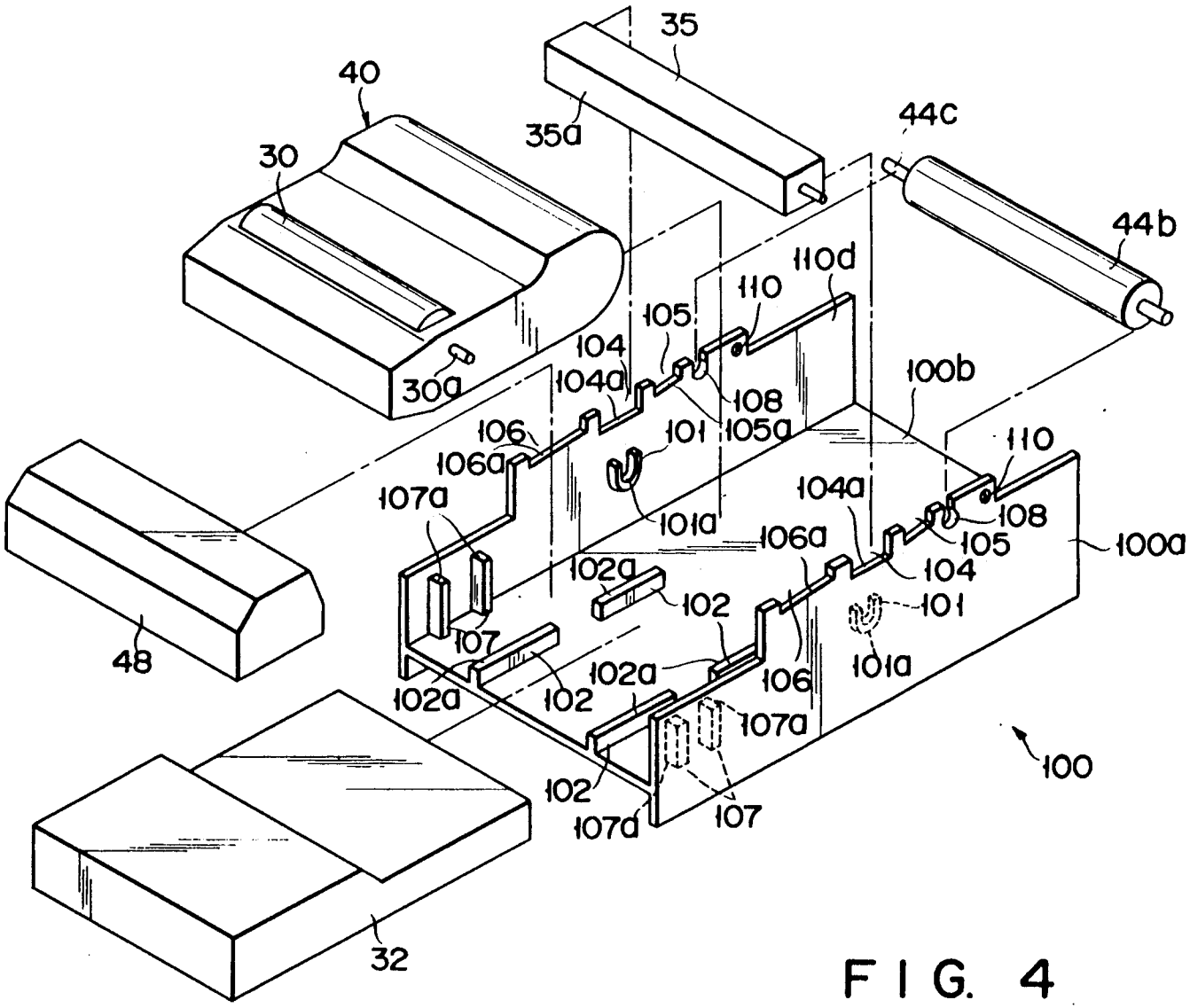

More specifically, as shown in FIGS. 3 and 4, the support frame 100 comprises a pair of substantially rectangular side plates **100*a* arranged to be parallel and opposite to each other, and a coupling plate 100*b* which extends horizontally and couples these side plates 100*a* with each other. The support frame 100** is constituted by an integrally molded product made of metal or synthetic resin.

A projection 101 having a U-shaped cross-section is formed on a substantially center portion of the inner surface of each side plate **100*a*. The inner surface of the projections 101 defines a recess 101*a* opening upward and inward. These projections 101 constitute a first support portion for supporting the image forming process cartridge 40. Specifically, the cartridge 40 is supported by the support frame 100 while axial ends of the drum shaft 30*a* are rotatably fitted in the recesses 101*a* of the projections 101. The cartridge 40 can be removed upward from the support frame 100**.

Four elongate first ribs 102 are formed on the upper surface of the coupling plate **100*b* and extend in a direction perpendicular to the axis of the photoconductive drum 30. The first ribs 102 constitute a second support portion for supporting the exposure unit 32. The unit 32 is mounted on the first ribs 102 and is removable from the support frame 100** upward.

First through third recesses 104, 105, and 106 are formed on the upper edge of each side plate **100*a*. The first recesses 104 are located above the projections 101 and constitute a fourth support portion for supporting the transfer charger 35. Each recess 104 has the same shape and size as those of the cross-section of the lower portion of a shield case 35*a* of the transfer charger 35. The transfer charger 35 is supported on the support frame 100 while the lower portions of both ends of the shield case 35*a* are fitted in the first recesses 104**.

The second and third recesses 105 and 106 are located on both sides of the first recesses 104 and constitute forth and fifth support portions for supporting the first and second paper guides 43 and 47, respectively. Each second recess 105 has substantially the same shape and size as those of the cross-section of the first paper guide 43. The first paper guide 43 is supported on the support frame 100 while the two end portions thereof are fitted in the second recesses 105. Similarly, each third recess 106 has substantially the same shape and size as those of the cross-section of the second paper guide 47. The second paper guide 43 is supported on the support frame 100 while the two end portions thereof are fitted in the third recesses 106.

A pair of second ribs 107 are formed on the front portion of each side plates **100*a* and extend from the coupling plate 100*b* in a direction perpendicular to the plate 100*b*. The second ribs 107 constitute a fifth support portion for supporting the fixing unit 48. The fixing unit 48 is supported by the support frame 100 while it is mounted on the upper surfaces of the ribs 107. The unit 48** is removable from the support frame upward.

In addition, each side plate **100*a* has first and second through holes 108 and 110 located at the side of the second recess 105. Each first through 108 is open to the upper edge of the side plate 100***a* through a slit The lower aligning roller 44*b* is rotatably supported by the support frame 100 while two axial ends of a rotational shaft 44*c* of the roller 44*b* are rotatably fitted in the first through holes 108. The first through holes 108 constitute a seventh supporting portion for supporting the lower aligning roller 44*b*. Pivotal shafts (not shown) of an upper cover 15 (described later) are rotatably inserted into the second through holes 110.

The transfer charger 35, first and second paper guides 43 and 47, and lower aligning roller 44*b* are removable from the support frame 100 upward.

The inner surfaces of the projections 101 constitute a first positioning portion for positioning the drum shaft 30*a*, i.e., the photoconductive drum 30 with respect to the support frame 100. The upper surfaces 102*a* of the first ribs 102 constitute a second positioning portion for positioning the exposure unit 32. The inner surfaces 104*a*, 105*a*, and 106*a* of the first to third recesses 104, 105, and 106 constitute third to fifth positioning portions for positioning the transfer charger 35, and first and second paper guides 43 and 47, respectively. The upper surfaces 107*a* of the second ribs 107 constitute a sixth positioning portion for positioning the fixing unit 48. Further, the first through holes 108 constitute a seventh positioning portion for positioning the lower aligning roller 44*b*. These first to seventh positioning portions are formed such that their relative positions are set with high precision.

The process cartridge 40, the exposure unit 32, the transfer charger 35, the first and second paper guides 43 and 47, the fixing unit 48, and the lower aligning roller 44*b* supported by the first to seventh support portions are positioned with reference to the first to seventh positioning portions, respectively.

In this arrangement, therefore, the components which tend to influence image quality, i.e., the image forming process cartridge 40, the exposure unit 32, and the transfer charger, and the components which tend to conveyance of the paper P, i.e., the first and second paper guides 43 and 47, the fixing unit 48, and the lower aligning roller 44*b*, are supported by the support frame 100 serving as a common member. At the same time, the positioning of these components is performed by the positioning portions formed on support frame 100.

As shown in FIGS. 1 and 3, the upper surface portion of the apparatus main body 10 is constituted by an upper cover 15. The upper cover 15 is supported on the support frame 100 through the pivotal shafts inserted in the second through holes 110 (see FIG. 4), and is rotatable through a predetermined angle in a direction indicated by arrow A. The transfer charger 35, the first and second paper guides 43 and 47, the upper aligning roller 44*a*, and the upper discharge roller 49*b* are mounted on the inner surface of the upper cover 15. Specifically, the charger 35, and the first and second paper guides 43 and 47 are fixed to the cover 15 through compression springs 112, 114, and 116, respectively.

When the cover 15 is pivoted upward, the transfer charger 35, and the first and second paper guides 43 are removed from the support frame 100 and greatly displaced upward. Also the upper aligning roller 44*a* and the upper discharge roller 49*b* are displaced upward. With this operation, most of the paper convey path 42 and most of components remaining in the main body 10 are exposed. For this reason, removal of the paper P upon jamming and maintenance/inspection and replacement of the above mentioned components can be easily and effectively performed.

When the cover 15 is closed, the transfer charger 35, and the first and second paper guides 43 and 47 are automatically fitted in the first to third recesses 104, 105 and 106 of the support frame 100 and urged by the compression springs 112, 114, and 116 against the third to fifth positioning portions, respectively. Thus, the charger 35 and the first and second paper guides 43 and 47 are securely positioned relative to the support frame 100. When the cover 15 is closed, the upper aligning roller 44*a* and the upper discharge roller 49*b* are brought into contact with the lower rollers 44*b* and 49*a*, respectively.

A paper empty switch (not shown) for detecting sheets of paper P in the paper cassette 14 is arranged near the pickup roller 45. In addition, an aligning roller switch 55 and a paper discharge switch 56 are respectively arranged near the aligning rollers 44*a* and 44*b* and the discharge roller pair 49 to detect the paper P.

A control board 58 on which a control circuit is mounted is arranged in a board storage portion 57 together with a printer control board 59 on which a printer control circuit is mounted. The board storage portion 57 is defined in a lower portion of the apparatus main body 10. The control circuit controls each electric device arranged in the apparatus main body 10 to control execution of an electrophotographic process. The printer control circuit controls an operation of the control board 58.

In an image forming operation of the laser printer having the above-described arrangement, first, the photoconductive drum 30 is rotated, and the surface potential of the drum 30 is kept constant by the preexposure unit 37. The surface of the drum 30 is uniformly charged by the charger 31. Subsequently, the surface of the drum 30 is scanned/exposed with the laser beam R emitted from the laser exposure unit 32. As a result, an electrostatic latent image corresponding to an image signal is formed on the drum surface.

The formed electrostatic latent image is developed as a toner image by the developing unit 34 using a one-component developing agent D consisting of toner t and is supplied to the image transfer portion 41.

In synchronism with this toner image forming operation, paper P is picked up from the paper cassette 14 or is manually inserted from a manual insertion guide 65. The paper is then conveyed to the image transfer portion 41 through the aligning rollers 44*a* and 44*b* and the first paper guide 43. The toner image formed on the photoconductive drum 30 in advance is transferred onto the paper P by the transfer charger 35. Subsequently, the paper P is guided by the second paper guide 47 to be conveyed to the fixing unit 48 through the paper convey path 42. In the fixing unit 48, the toner image is melted/fixed on the paper P. Thereafter, the paper P is discharged onto the paper discharge tray 12 through the paper discharge roller pair 49.

Note that after the toner image is transferred onto the paper P, the residual toner particles on the drum 30 is removed by the drum cleaner 36.

According to the laser printer having the above-described arrangement, the components which tend to influence image quality, i.e., the process cartridge 40, the exposure unit 32, and the transfer charger 35, and the components required to ensure proper conveyance of the paper P, i.e., the first an second paper guides 43 and 47, the fixing unit 48, and the lower aligning roller 44*b*, can be supported and positioned by the support frame 100 as a common support member having the positioning portions. In this arrangement, the positional relationship among the respective components can be set with high precision, in comparison with a conventional apparatus wherein various types of components are positioned by positioning pins, studs, positioning frames, guides, or the like arranged on the main body frame. Therefore, an image having excellent image quality can be obtained by the present invention. In addition, a decrease in number of components assembly performance and reduces manufacturing costs.

Figure 5:
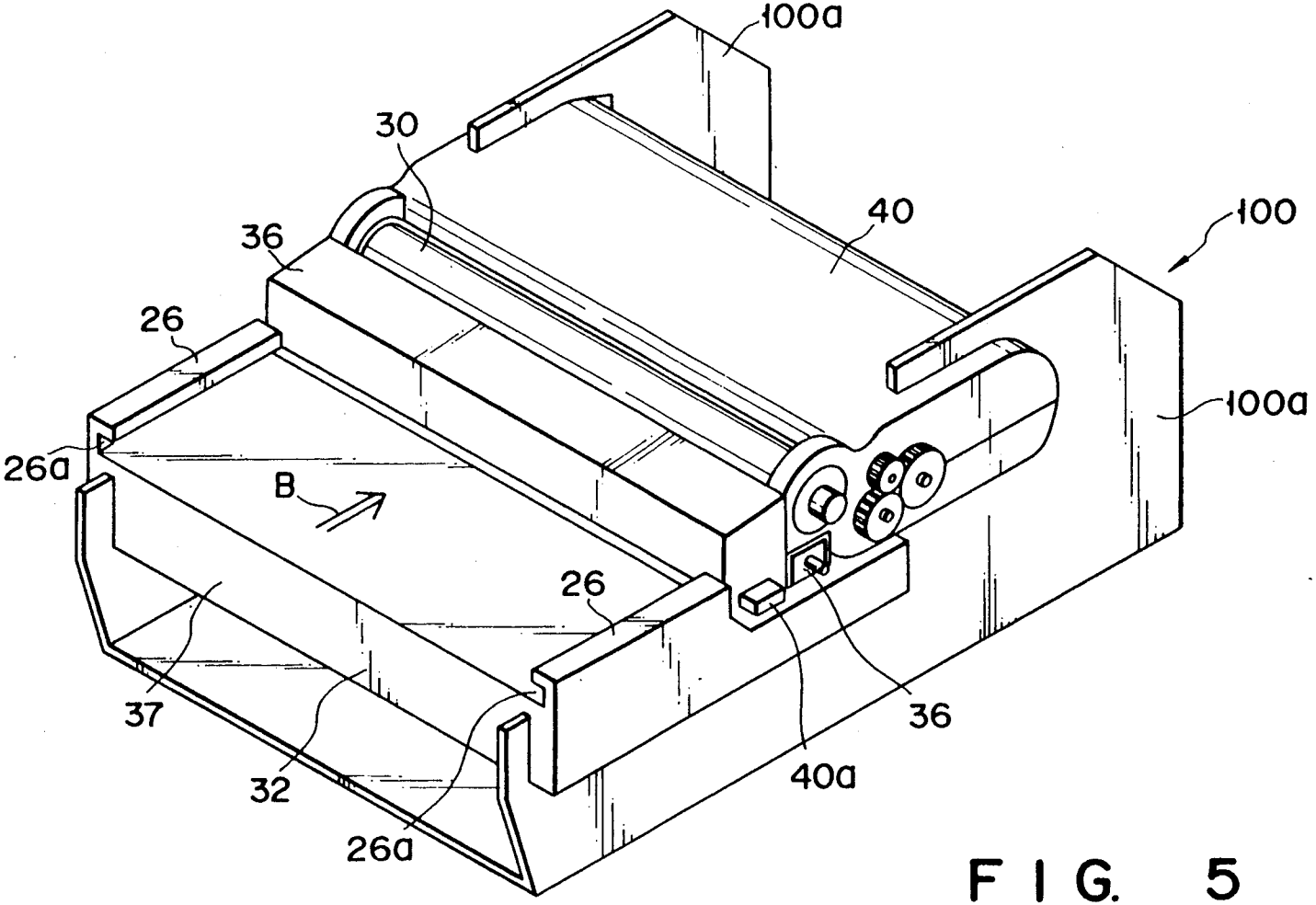
Figure 6:
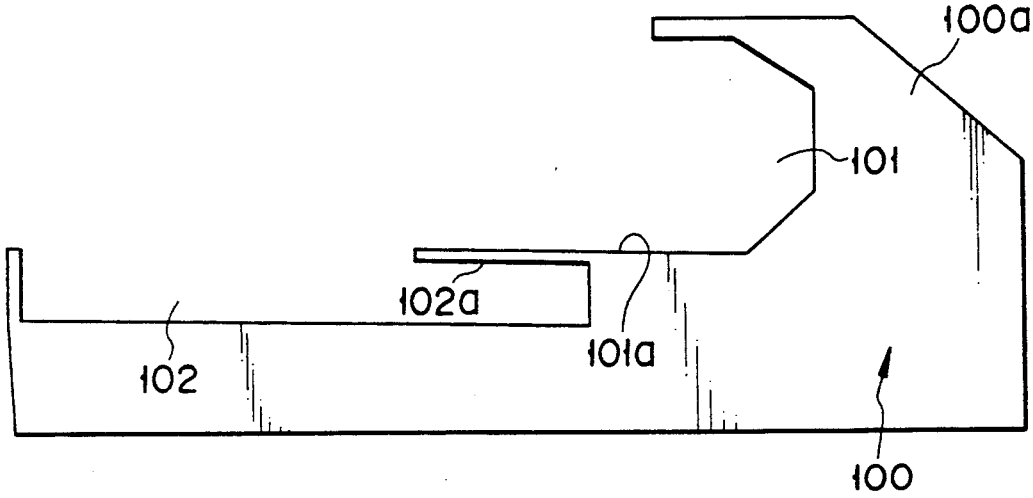
Figure 7:
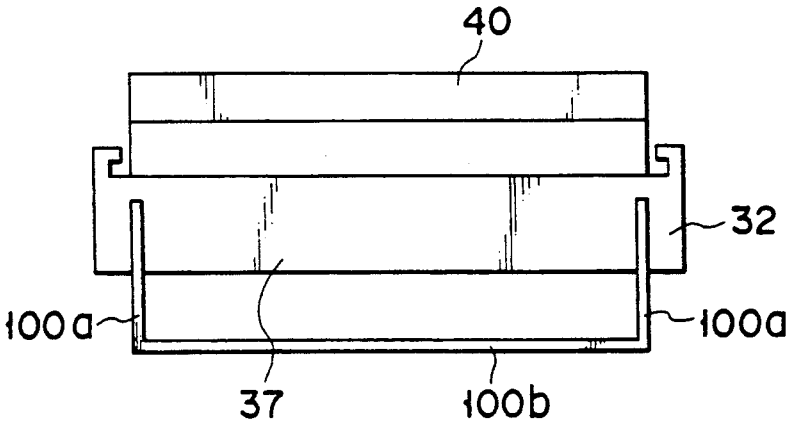

FIGS. 5 to 7 show a second embodiment of the present invention. The same reference numerals in the second embodiment denote the same parts as in the first embodiment, and a detailed description thereof will be omitted.

According to the second embodiment, each side plate 100*a* of a support frame 100 is constituted by only a first support portion for supporting and positioning an image forming process cartridge 40, and a second support portion for supporting and positioning an exposure unit 32. The first support portion is constituted by a recess 101 open to the front. The lower edge 101*a* of each recess 101 which extends substantially horizontally constitutes a first positioning portion. The second support portion is constituted by a recess 102 open upward. The upper edge 102*a* of each recess 102 constitutes a second positioning portion. Each upper edge 102*a* is located near a corresponding lower edge 101*a* of the recess 101 and extends parallel to the edge 101*a*.

A casing 37 of the exposure unit 32 integrally includes a pair of guide rails 26 protruding upward therefrom and extending parallel to the side plates 100*a* of the support frame 100. These guide rails 26 have guide grooves 26*a* arranged to oppose each other and extending parallel to the side plates 100*a*.

Guide projections 40*a* for engagement with the guide grooves 26*a* respectively extend from the two side surfaces of a front portion of the process cartridge 40.

According to the second embodiment having the above-described arrangement, the exposure unit 32 is supported and positioned by the support frame 100 in such a manner that the two end portions of the unit 32 are respectively fitted in the second recesses 102 as the second support portion of the support frame 100. The process cartridge 40 is then guided from the front side of the apparatus to a position above the exposure unit 32, and the guide projections 40*a* are respectively engaged with the guide grooves 26*a* of the exposure unit 32, as shown in FIG. 7. While the cartridge 40 is guided by the guide rails 26, it is moved in a direction indicated by an arrow B in FIG. 5 and introduced into the first recesses 101. As a result, the cartridge 40 is fitted in the first recesses 101 and is supported and positioned by the support frame 100.

Note that the cartridge 40 and the exposure unit 32 are positioned with reference to the first and second positioning portions with their relative positions being set with high precision.

In the second embodiment, a transfer charger, first and second paper guides, aligning rollers, and the like are fixed to an upper cover 15 (see FIG. 1) of an apparatus main body 10.

In the second embodiment having the above arrangement, the image forming process cartridge 40 and the exposure unit 32 can be supported and positioned with high precision by using the common support frame 100. In addition, since the guides 26 for guiding the process cartridge to the first support portion are integrally formed with the exposure unit 32, no separate guides are required. This allows a decrease in number of components and an improvement in assembly performance.

The present invention is not limited to the above-described embodiments. Various changes and modifications can be made within the spirit and scope of the invention.

For example, the present invention can be applied to an image forming apparatus in which a photoconductive drum, a developing unit, a charger, and the like are not formed into a unit. In this case, support portions for, e.g., the drum, the charger, and the developing unit are independently formed on the support frame.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

a process unit removably mounted to a body of the image forming apparatus, said process unit having an image carrier and means for forming an image on the image carrier;

an optical unit for exposing alight on said image carrier to form a latent image thereon;

a transfer unit for transferring the image on said image carrier formed by the forming means onto a transfer medium;

means for feeding the transfer medium between the image carrier and the transfer unit;

means for fixing the transferred image onto the transfer medium; and a support unit including a base member provided on the body, a first support portion for positioning said process unit, a second support portion for positioning said optical unit, a third support portion for positioning said transfer unit, a fourth support portion for positioning said feeding means, and a fifth support portion for positioning said fixing means, said first to fifth support portions being formed on the base member.

2. An apparatus according to claim 1, wherein said base member is integrally provided with a projection constituting said first support portion, ribs constituting said second support portion, and recesses constituting said third support portion.

3. An apparatus according to claim 1, wherein said base member includes a pair of side plates opposing and substantially in parallel with each other, and a coupling plate coupling the side plates with each other and formed integral with the side plates.

4. An apparatus according to claim 3, wherein said first support portion includes a pair of projections respectively projecting from the side plates so as to oppose each other, said second support portion includes ribs formed on said coupling plate and on which said optical unit is mounted, and a pair of recesses respectively formed on upper ends of the side plates so as to oppose each other and in which said transfer unit is fitted.

5. An apparatus according to claim 4, wherein said process unit has a casing, and said image carrier includes a photoconductive drum which is arranged in the casing and has a drum shaft, said drum shaft having two axial ends which project outside of the casing and are supported by said projections.

6. An apparatus according to claim 5, wherein each of said projections has a U-shaped cross-section and an inner surface defining a recess opening upward and inward, and said axial ends of the drum shaft is removably fitted in said recesses of the projections.

7. An apparatus according to claim 4, wherein said transfer unit includes a substantially rectangular shield case having two end portions removably fitted in said pair of recesses.

8. An apparatus according to claim 7, which further comprises means for urging said transfer unit into said pair of recesses.

9. An apparatus according to claim 4, wherein each of said projections has a surface for positioning said image forming unit with respect to said side plates, each of said ribs has an upper surface for positioning said optical unit with respect to said coupling plate, and each of said recesses has an inner surface for positioning said transfer unit with respect to said side plates.

10. An apparatus according to claim 1, which further comprises:

first guide means for guiding the transfer medium to a position between said transfer unit and said image carrier; and second guide means for guiding the transfer medium passed through the position between said transfer means and said image carrier; and wherein said base member includes a sixth support portion for positioning said first guide means, and a seventh support portion for positioning said second guide means.

11. An apparatus according to claim 10, wherein said body includes an upper cover movable between an open position for exposing an interior of the body and a closed position for closing the body; and means for urging said transfer unit and said first and second guide means onto said third to fifth support portions, respectively, when said upper cover is at the closed position, and said transfer unit and said first and second guide means being connected to said upper cover through said urging means so that said transfer means and said first and second guide means are pulled up from said base member when said upper cover is moved to said open position.

12. An apparatus according to claim 1, wherein said base member is molded with said first to fifth support portions.

13. An image forming apparatus comprising:

a support frame arranged in a body of the image forming apparatus and integrally provided with first, second, third, fourth and fifth support portions, said support frame having a pair of side plates opposing each other, and a coupling plate coupling the side plates;

a process unit removably arranged between the side plates of the support frame and positioned by the first support portion, said process unit having an image carrier and means for forming an image on the image carrier;

an optical unit for exposing light onto said image carrier to form a latent image thereon, said optical unit being removably arranged between the side plates and positioned by the second support portion with respect to the process unit;

a transfer unit for transferring the image on said image carrier formed by the forming means onto a transfer medium, said transfer unit being removably arranged between the side plates and positioned by the third support portion with respect to the process unit;

means for feeding the transfer medium between the image carrier and the transfer unit, said feeding means being removably arranged between the side plates and positioned by the fourth support portion with respect to the process unit; and means for fixing the transferred image onto the transfer medium, said fixing means being removably arranged between the side plates and positioned by the fifth support portion with respect to the process unit.

* * * * *